US008215373B2

(12) United States Patent
Kloskowski et al.

(10) Patent No.: US 8,215,373 B2
(45) Date of Patent: Jul. 10, 2012

(54) COATING COMPOSITION WHICH ADSORBS ADOUROUS AND HARMFUL SUBSTANCES AND IS INTENDED FOR THE BOX CASTING OF METALS

(75) Inventors: Michael Kloskowski, Düsseldorf (DE); Antoni Gieniec, Hilden (DE); Reinhard Stötzel, Solingen (DE)

(73) Assignee: ASK Chemicals GmbH, Hilden (DE)

( * ) Notice: Subject to any disclaimer, the term of this patent is extended or adjusted under 35 U.S.C. 154(b) by 42 days.

(21) Appl. No.: 12/994,586

(22) PCT Filed: May 27, 2009

(86) PCT No.: PCT/EP2009/056433

§ 371 (c)(1),
(2), (4) Date: Nov. 24, 2010

(87) PCT Pub. No.: WO2009/144241

PCT Pub. Date: Dec. 3, 2009

(65) Prior Publication Data

US 2011/0073267 A1 Mar. 31, 2011

(30) Foreign Application Priority Data

May 27, 2008 (DE) ..... 10 2008 025 311

(51) Int. Cl.
*B22C 3/00* (2006.01)

(52) U.S. Cl. ..... 164/33; 164/72; 164/410; 164/349

(58) Field of Classification Search ..... 164/33, 164/72, 349, 410; 425/210, 812; 249/114.1
See application file for complete search history.

(56) References Cited

U.S. PATENT DOCUMENTS

| | | | | |
|---|---|---|---|---|
| 1,717,820 | A | | 6/1929 | Wallace |
| 3,938,578 | A | | 2/1976 | Epstein et al. |
| 4,546,124 | A | | 10/1985 | Laitar et al. |
| 5,573,580 | A | | 11/1996 | Bartsch et al. |
| 5,769,933 | A | * | 6/1998 | Landis ..... 106/38.2 |
| 7,299,858 | B2 | * | 11/2007 | Dierssen ..... 164/520 |
| 7,858,195 | B2 | | 12/2010 | Aslan et al. |
| 2007/0102137 | A1 | | 5/2007 | Dierssen |
| 2010/0155010 | A1 | | 6/2010 | Knechten |

FOREIGN PATENT DOCUMENTS

| | | | | |
|---|---|---|---|---|
| CA | 2 349 878 | C | | 5/2000 |
| CN | 86 1 06485 | A | | 4/1988 |
| CN | 86 1 06521 | A | | 4/1988 |
| DE | 158 258 | | | 10/1903 |
| DE | 12 122 250 | B | | 10/1966 |
| DE | 42 03 904 | C1 | | 4/1993 |
| DE | 10 2007 031 448 | A1 | | 1/2009 |
| EP | 0177871 | A2 | | 4/1986 |
| EP | 1137500 | A1 | | 10/2001 |
| JP | 52-123926 | A | | 10/1977 |
| JP | 55-007096 | B | | 2/1980 |
| JP | 57-004352 | A | | 1/1982 |
| JP | 02-11243 | A | | 1/1990 |
| JP | 07-112238 | A | | 5/1995 |
| JP | 2007083281 | A | * | 4/2007 |
| WO | WO 03-015956 | A2 | | 2/2003 |

OTHER PUBLICATIONS

International Search Report, completed on Sep. 1, 2009, for corresponding International Application No. PCT/EP2009/056433 (with English translation).

International Preliminary Report on Patentability, completed on Mar. 29, 2010, for corresponding International Application No. PCT/EP2009/056433 (with English translation).

* cited by examiner

*Primary Examiner* — Jessica L Ward
*Assistant Examiner* — Kevin E Yoon
(74) *Attorney, Agent, or Firm* — Locke Lord LLP; Alan B. Clement; Peter J. Fallon

(57) ABSTRACT

The invention relates to a casting mould for the casting of metals, wherein a layer consisting of a material which absorbs harmful substances on at least sections of gas outlet surfaces of the casting mold, in particular the top side thereof. The invention also relates to a coating composition, to a process for producing the casting mold and to the use thereof for casting of metals.

14 Claims, No Drawings

COATING COMPOSITION WHICH ADSORBS ADOUROUS AND HARMFUL SUBSTANCES AND IS INTENDED FOR THE BOX CASTING OF METALS

The invention relates to a casting mould for the casting of metals, a coating composition and a process for producing a casting mould.

Most products in the iron and steel industry and the non-ferrous metal industry pass through casting processes for the first shaping. In so doing, molten liquid materials, ferrous metals or non-ferrous metals are converted into geometrically defined objects having specific material properties. Initially in some cases, very complex casting moulds for receiving the melt must be produced for shaping the castings. Casting moulds for producing metal bodies are composed of so-called cores and moulds. The casting mould substantially forms a negative mould of the casting to be produced, wherein cores serve to form cavities in the interior of the casting whilst the moulds form the outer boundary. At the same time, different requirements are imposed on the cores and moulds. In the case of moulds a relatively large surface area is available for removing gases produced during the casting due to the action of the hot metal. In the case of cores, there is usually only a very small area available over which the gases can be removed. If gas evolution is too severe, there is thus the risk that gas from the core will pass over into the liquid metal and lead to the formation of casting defects there. The inner cavities are therefore frequently formed by cores which were solidified by cold box binders, i.e. a binder based on polyurethanes, whilst the outer contour of the casting is formed by less expensive moulds such as a green sand mould, a mould bound by a furan resin or a phenol resin or by a steel ingot mould.

Casting moulds consist of a refractory material, for example, quartz sand whose grains are bound by a suitable binder after the final shaping of the casting mould in order to ensure sufficient mechanical strength of the casting mould. A refractory moulding material which is reacted with a suitable binder is therefore used to produce casting moulds. The moulding material mixture obtained from moulding material and binder is preferably present in a pourable form so that it can be poured into a suitable hollow mould and compacted there. A firm cohesion between the particles of the moulding material is produced by the binder so that the casting mould acquires the requisite mechanical stability.

Both organic and inorganic binders can be used to produce the casting moulds, which can be cured by cold or hot processes. In this context, processes which can be carried out substantially at room temperature without heating the moulding material mixture are designated as cold processes. The curing usually takes place by a chemical reactions which can be triggered, for example, by passing a gaseous catalyst through the moulding material mixture to be cured or by adding a liquid catalyst to the moulding material mixture. In hot processes, after the shaping the moulding material mixture is heated to a sufficiently high temperature in order, for example, to expel the solvent contained in the binder or in order to initiate a chemical reaction through which the binder is cured by cross-linking.

At the present time, organic binders such as, for example, polyurethane, furan resin or epoxy acrylate binders are frequently used for producing casting moulds, the curing of the binder being accomplished by adding a catalyst.

The selection of the suitable binder is determined according to the shape and the size of the casting to be produced, the production conditions and the material used for the casting.

Thus, polyurethane binders are frequently used in the production of small castings produced in large numbers since these enable fast cycle times and therefore series production.

Processes in which the curing of the moulding material mixture is accomplished by heat or by subsequent addition of a catalyst have the advantage that the processing of the moulding material mixture is not subject to any particular time restrictions. The moulding material mixture can initially be produced in larger quantities which are then processed within a longer time interval, usually several hours. The curing of the moulding material mixture only takes place after the shaping, a rapid reaction being strived for. The casting mould can be removed from the moulding tool directly after the curing so that short cycle times can be accomplished. However, in order to obtain a good strength of the casting mould, the curing of the moulding material mixture must take place uniformly within the casting mould. If the curing of the moulding material mixture is to take place by subsequent addition of a catalyst, the casting mould is gassed with the catalyst after the shaping. For this purpose, the gaseous catalyst is passed through the casting mould. The moulding material mixture cures immediately after contact with the catalyst and can therefore be removed very rapidly from the moulding tool. With increasing size of the casting mould, it becomes more difficult to provide a quantity of catalyst sufficient for curing the moulding material mixture in all sections of the casting mould. The gassing times become longer although despite this sections can be formed in the casting mould which can only be reached with difficulty or cannot be reached at all by the gaseous catalyst. The amount of catalyst therefore increases substantially with increasing size of the casting mould.

Similar difficulties arise in hot curing processes. In this case, the casting mould must be heated to a sufficiently high temperature in all sections. With increasing size of the casting mould, on the one hand the times for which the casting mould must be heated to a certain temperature for curing are lengthened. Only then can it be ensured that the casting mould has the required strength in its interior. On the other hand, as the size of the casting mould increases, the curing becomes very expensive on the apparatus side.

When producing casting moulds for large castings, for example, engine blocks of ships or large machine parts such as hubs of rotors for wind power plants, no-bake binders are usually used. In the no-bake process the refractory moulding material is firstly coated with a catalyst. The binder is then added and is distributed uniformly by mixing onto the grains of the refractory moulding material already coated with the catalyst. The moulding material mixture is then moulded into a moulding. Since binder and catalyst are distributed uniformly in the moulding material mixture, curing takes place largely uniformly even with large mouldings.

During casting, the cured binder should decompose under the influence of the heat of the liquid metal and the reducing atmosphere produced during casting so that the casting mould loses its strength. The casting mould can then be easily removed from the casting. It is particularly important that the cores used in the casting mould lose their strength so that the sand which was used to produce the cores can easily be poured out from the cavities of the casting mould. The decomposition of the binder results in the release of a number of gaseous harmful substances which, for example, must be captured and removed via suitably designed extraction devices. The harmful substances are formed on the one hand by the decomposition of the resin and on the other hand by the decomposition of components which were added to the binder for curing or for modifying its properties. Thus, for example, the aromatic sulphonic acids used as catalysts in the no-bake process, in particular p-toluene sulphonic acid, benzene sulphonic acid and xylene sulphonic acid, decompose and, in addition to sulphur dioxide, release aromatic harmful substances such as benzene, toluene or xylene (BTX). Some of these decomposition products also remain in the used sand and can be released during the reprocessing.

As a result of their carcinogenic effect, very low MAK values (MAK=maximum workplace concentration) apply in particular to aromatic substances. For benzene the MAK value is only 3.2 mg/m$^3$, for toluene and xylene correspondingly 190 mg/m$^3$ and 440 mg/m$^3$. This has now become a problem in foundries since adherence to these limiting values requires very expensive extraction systems and filters.

The composition of the gas mixture produced during casting is very complex and comprises a plurality of compounds which can have very different chemical properties. In addition to the afore-mentioned aromatic substances, for example, acidic substances such as sulphur compounds or basic components such as, for example, amines can also be present in the waste gases. In addition to the gaseous components, the waste gas produced during casting also contains dusts which are entrained by the released gases. These dusts are usually very fine and can therefore also be hazardous to health.

In addition to their heath-endangering effect, the gaseous substances released during casting also constitute a problem because of their strong odour. The human sense of smell is very sensitive to some compounds so that even low concentrations are sufficient to produce an odour which is perceived as unpleasant. Usually it is not possible to completely capture the waste gases released during casting by an extraction system, so that an odorous nuisance in the corresponding workshop is unavoidable.

It was therefore the object of the invention to provide a casting mould that releases a smaller quantity of perturbing gaseous substances during casting.

This object is achieved with a casting mould having the features of patent claim 1. Advantageous embodiments are the subject matter of the dependent patent claims.

In the casting mould according to the invention, a layer consisting of a material which absorbs harmful substances is arranged at least in sections on gas outlet surfaces of the casting mould. The layer consisting of a material which absorbs harmful substances is subsequently also designated hereinafter as "absorber layer".

Gas outlet surfaces are understood to be the surfaces of the casting mould through which gaseous components can escape from the casting mould during the casting. The gas outlet surface can correspond to the entire outer surface of the casting mould. However, it is also possible that only a part of the outer surface of the casting mould will be used for the release of gaseous components. Thus, in box casting of metals, a box is used for the structure of the casting mould which covers the underside and the side surfaces of the casting mould. These surfaces are then not available or only available to a very restricted extent for any release of gaseous components. In this case, substantially only the upper side of the casting mould is available for any release of gaseous components.

An outer surface of the casting mould is understood as the surfaces through which waste gases produced during casting can leave the casting mould. This outer surface is visible from outside when viewing the casting mould and does not come in contact with the liquid metal during casting. In contrast to this, an inner surface is understood, for example, as the surface of the moulding cavity surrounded by the casting mould.

Preferably at least the upper side of the casting mould is coated with the layer consisting of a material which absorbs harmful substances at least in sections. The upper side of the casting mould is understood as the side of the casting mould which is arranged at the top during casting. During casting, the predominant portion of the released gases leaves the casting mould via its upper side. Since a layer consisting of a material which absorbs harmful substances is arranged there in the casting mould according to the invention, the gas passes through this layer. In this case, harmful substances contained in the gas are absorbed in the absorber layer and consequently a considerable proportion of the harmful substances are removed from the gas stream. Per se, it would also be possible to provide sections of the outer surface of the casting mould with a gastight coating in order, for example, to allow the waste gases to specifically escape from side surfaces of the casting mould.

Absorbing a harmful substance is understood to mean both a binding of the harmful substance in the absorber layer and also a conversion of the harmful substances into harmless compounds, wherein the harmless compounds need not necessarily be bound in the absorber layer but are released again into the waste gas stream and can leave the casting mould. Absorbing a harmful substance is therefore generally understood as the removal of the harmful substance from the gas stream which leaves the casting mould during casting.

Harmful substances are deemed per se to be all substances which are contained in the gas released during casting and which have an environmental or health damaging effect or which smell strongly. In particular, harmful substances are deemed to be those substances for which limits apply for the loading in the workplace. In particular harmful substances are deemed to be those substances whose MAK is lower than 1 g/m$^3$, preferably lower than 500 mg/m$^3$.

The layer consisting of a material which absorbs harmful substances preferably covers the entire upper side of the casting mould. Per se, the side walls of the casting mould can also be covered with the layer consisting of a material which absorbs harmful substances.

According to its shape, the person skilled in the art can provide the casting mould with the layer consisting of a material which absorbs harmful substances in suitable sections. For example, if box casting moulds are used, it is not usually necessary to provide the layer consisting of a material which absorbs harmful substances according to the invention on the side surfaces of the casting mould since the side surfaces are sealed by the box.

The casting mould is initially constructed in the same way as already known casting moulds, wherein however, a layer consisting of a material which absorbs harmful substances is additionally arranged at least on a section of the gas outlet surfaces, i.e., the outer surface, particularly preferably on the upper side of the casting mould, wherein this absorber layer partially or completely covers the upper side of the casting mould.

The casting mould consists in a manner known per se of a granular refractory moulding material which is solidified with a binder. The casting mould can be composed of moulds and cores and comprises a mould cavity which substantially corresponds to the shape of the casting.

All the usual binders for the manufacture of such casting moulds can be used per se as binders, wherein both inorganic and organic binders can be used. An exemplary inorganic binder is water glass. For example, polyurethane, furan resin or epoxy acrylate binders can be used as organic binder in which the curing of the binder takes place by adding a catalyst. However, it is also possible to use organic binders which are cured by other processes, for example by heating.

The casting mould is particularly preferably solidified with a furfuryl alcohol urea resin, a phenol furfuryl alcohol resin or a phenol resin.

Usual refractory materials can be used as refractory material. Examples of refractory materials are quartz sand, zirconium sand, olivine sand, aluminium silicate sand and chrome ore sand or mixtures thereof.

The casting mould can be pre-treated in the usual manner, for example, by coating the surfaces of the mould cavity which come in contact with the liquid metal with a facing material. Usual facing materials can be used.

A layer consisting of a material which absorbs harmful substances is arranged on at least one section of the gas outlet surface, in particular the upper side of the casting mould. The layer can initially have an arbitrary structure per se. Thus, the layer can have a homogeneous structure. However, it is also possible that the layer is constructed of a layer stack, wherein individual layers of the layer stack can have a different composition.

The absorber layer should be gas-permeable, i.e. porous. The porosity should be sufficiently high that the released gases can largely pass through the absorber layer unhindered, i.e. no excess pressure forms in the casting mould which can lead to gas inclusions in the casting. The gas permeability Gd preferably lies at a value of more than 50, and is preferably greater than 100, particularly preferably greater than 200.

The gas permeability Gd specifies how many $cm^3$ of air pass on average through a test specimen having a base area of 1 $cm^2$ and 1 cm height at an excess pressure of 1 cm water column in 1 min. The measurement is made using a type PDU permeability test apparatus from Georg Fischer AG, Schaffhausen, Switzerland.

The gas permeability is defined by the following relationship:

$$Gd = \frac{Q \cdot h}{F \cdot p \cdot t}$$

where:

Q: is the through-flowing volume of air (2000 $cm^3$)

h: is the height of the test specimen

F: is the cross-sectional area of the test specimen (19.63 $cm^2$)

p: is the pressure in water column t: is the through-flow time for 2000 $cm^3$ of air in min.

The absorber layer can be constructed of a granular material that is loosely applied to the upper side of the casting mould. However, it is also possible that the absorber layer is bound, i.e. forms a solid, continuous layer, on the upper side of the casting mould.

The absorber layer can comprise a single component which acts as material which absorbs harmful substances. However, it is also possible that the layer comprises a plurality of components, wherein some or all the components act as material which absorbs harmful substances. In addition to a component which acts as material which absorbs harmful substances, the layer can, for example, comprise a binder or framework materials which improve the gas permeability of the absorber layer.

The layer consisting of a material which absorbs harmful substances preferably has a different composition-from the casting mould so that a clear separation between the casting mould and the layer consisting of a material which absorbs harmful substances can be determined.

The thickness of the layer consisting of a material which absorbs harmful substances is dependent on the quantity of gas released during casting and on the type and quantity of the harmful substances contained in the released gas. In the case of small casting moulds, even a comparatively thin layer consisting of a material which absorbs harmful substances can be sufficient whereas in the case of casting moulds for very large castings, the thickness of the layer consisting of a material which absorbs harmful substances can be very much greater and can be up to several centimeters.

According to a preferred embodiment, the layer consisting of a material which absorbs harmful substances has a thickness of at least 2.5 mm. According to a further embodiment, the layer thickness is at least 0.5 cm. It is usually sufficient for purifying the gases released during casting if the layer thickness is less than 5 cm. However, it is also possible to use even greater layer thicknesses.

The absorption of harmful substances can take place per se in an arbitrary manner. The harmful substances can be physically bound by the material which absorbs the harmful substances. However, it is also possible for the harmful substances to be bound by means of a chemical reaction of the material which absorbs the harmful substances, wherein these are converted, for example, into a non-volatile compound. Finally, it is also possible for the harmful substances to be decomposed in the layer which absorbs the harmful substances, into harmless substances, for example, carbon dioxide or water which can then be completely or partially released again from the layer consisting of a material which absorbs harmful substances.

According to a first embodiment, it is provided that the layer consisting of a material which absorbs harmful substances comprises at least one physical adsorber material which can physically adsorb harmful substances. This embodiment is particularly suitable for the removal of relatively non-polar harmful substances such as, for example, aromatic hydrocarbons, from the gas released during casting.

Preferably used as physical adsorber materials are compounds having a high specific surface area. Preferably used as compounds having a specific surface area of more than 800 $m^2/g$, preferably more than 1000 $m^2/g$, particularly preferably more than 1100 $m^2/g$. The specific surface area is preferably determined by the BET method in accordance with DIN 66 131.

Such physical adsorber materials preferably have a relatively low bulk density which is preferably selected in the range of 10 to 2000 g/l. A method for determining the bulk density is given in the examples.

The physical adsorber material preferably has an absorption capacity for iodine of at least 300 mg/g, preferably at least 500 mg/g, particularly preferably more than 800 mg/g. The absorption capacity of the physical adsorber material for iodine is determined by the method described in the standard ASTM D 1510.

In order to achieve a sufficient gas permeability of the layer consisting of a material which absorbs harmful substances, the average grain size ($D_{50}$) of the physical adsorber material is preferably selected to be greater than 100 μm, preferably greater than 150 μm. In order to achieve a uniform structure of the layer, it is preferable that the physical adsorber material has an average grain size ($D_{50}$) of less than 500 μm. The grain size distribution can be determined, for example, by laser granulometry.

The physical adsorber material is preferably selected from the group formed from activated charcoal, finely dispersed silicic acid, acidic solubilised clays, ashes, celluloses such as linters, rayon staple, viscose or similar materials. The physical adsorber material is preferably present in a fraction of 5 to 50 wt. % in the layer consisting of a material which absorbs harmful substances.

According to a further embodiment, the layer consisting of a material which absorbs harmful substances contains at least one chemical absorber material, which can bind harmful materials by a chemical reaction. The type of chemical reaction which leads to a removal of harmful substances from the gas stream released during casting is per se not subject to any restrictions. The chemical reaction can, for example, be a neutralisation by which means an acidic harmful substance, for example, an acidic sulphur compound is neutralised or converted into a salt and bound by the chemical absorber material. However, it is also possible that the chemical reaction is a redox reaction in which a harmful substance is, for example, oxidised and converted, for example, into harmless compounds.

For this purpose the layer consisting of a material which absorbs harmful substances can, for example contain an oxidising agent or a reducing agent or a catalyst which catalyses the oxidation or reduction of the harmful substance. However, it is also possible to provide compounds in the layer consisting of a material which absorbs harmful substances which coordinatively bind the harmful substances. Suitable compounds are, for example, cyclodextrines which can enclose harmful compounds.

The chemical absorber material is preferably present in granular form in the layer consisting of a material which absorbs harmful substances. Since the chemical absorber material is modified by the reaction with harmful substances, the average grain size of the chemical absorber material is preferably selected to be smaller than the average grain size of the physical adsorber material. The chemical absorber material preferably has an average grain size ($D_{50}$) of more than 10 μm preferably more than 20 μm. According to one embodiment of the invention, the average grain size of the chemical absorber material is selected to be less than 100 μm, preferably less than 50 μm.

According to a preferred embodiment it is provided that the chemical absorber material is a basic material. A basic material is understood as a material or a compound which leads to an alkaline reaction on contact with water. On contact with the basic material, the pH of the water is increased to more than 8, preferably more than 9. The measurement of the pH can be carried out, for example, using a glass electrode on a sample containing 10 g of the basic material per liter of water. This embodiment is suitable for removing acidic harmful substances from the gas released during casting. Such acidic harmful substances are produced, for example, when the binder of the casting mould contains sulphur-containing compounds. Such sulphur-containing compounds are, for example, sulphonic acids such as are used in furan or phenol resin no-bake processes.

The basic material is preferably selected from oxides, hydroxides and carbonates of the alkali metals and alkaline-earth metals. These basic materials are simply and cheaply accessible and can be processed without major difficulties. Both carbonates and hydrogen carbonates can be used. Calcium carbonate and/or calcium oxide or calcium hydroxide are particularly preferably used as basic material.

The at least one chemical absorber material can be present merely in the layer consisting of a material which absorbs harmful substances or in addition to the physical adsorber material. A combination of chemical absorber material and physical adsorber material is preferably used.

The chemical absorber material is preferably present in a fraction of 10 to 20 wt. % in the layer consisting of a material which absorbs harmful substances.

In addition to the physical or the chemical absorber material, further substances can also be contained in the layer consisting of a material which absorbs harmful substances. In this case, substances such as are generally used in facing materials for metal casting are preferably used.

According to one embodiment, the layer consisting of a material which absorbs harmful substances contains at least one refractory material which has an average grain size ($D_{50}$) of at least 50 μm Usual refractory materials in metal casting can be used as the refractory material. Examples of suitable refractory materials are quartz, aluminium oxide, aluminium silicates such as pyropyllite, kyanite, andalusite or chamotte, zirconium sand, olivine, talc, mica, graphite, coke, feldspar. The refractory material is prepared in powder form. The grain size is selected so that a stable structure is formed in the absorber layer and that the layer acquires a sufficiently high porosity so that the gases produced during casting can pass through the layer without forming an excessive counter-pressure. The refractory material suitably has an average grain size in the range of 100 to 500 μm, particularly preferably in the range of 120 to 200 μm.

The fraction of the refractory material in the layer consisting of a material which absorbs harmful substances is selected to be preferably in the range of 30 to 60 wt. %, preferably in the range of 40 to 50 wt. %.

In addition, for example, a binder can also be present in the layer. Usual binders can be used as binders such as, for example, clays in particular bentonite. However, other binders can also be present, for example, kieselsol. Per se, all binders used in facing materials can be present. At the same time, both inorganic and organic binders can be used.

The layer consisting of a material which absorbs harmful substances preferably also exhibits residual moisture. As a result, for example, polar harmful substances such as amines can be retained in the layer. Furthermore, the gases released during casting are cooled when they pass through the layer consisting of a material which absorbs harmful substances so that a fraction of the harmful substances is deposited in the layer. The layer consisting of a material which absorbs harmful substances preferably has a water content in the range of 0 to 60 wt. %, preferably 5 to 30 wt, %, particularly preferably 10 to 20 wt. %. The water content relates to the composition of the layer consisting of a material which absorbs harmful substances before casting.

According to a further embodiment, the layer consisting of a material which absorbs harmful substances comprises a porous supporting framework. The absorber materials and the further components of the absorber layer are then deposited on the porous supporting framework. The weight of the porous supporting framework is not included in the calculation of the fractions of these components.

Per se, any material which provides a sufficiently firm framework for receiving the further components of the absorber layer and which offers a sufficiently high porosity such that the gas produced during casting can pass through the layer can be used as the porous supporting framework. An open-pored solid foam, for example, or preferably a fabric or a fleece can be used as a porous supporting framework. Suitable materials from which such a fabric or fleece can be made are, for example, mineral wool, glass wool or mats made of synthetic fibers, for example, fibers made of perfluorinated hydrocarbons.

The porous supporting framework is preferably arranged in the form of mats on the upper side of the casting mould, wherein the thickness of the mats is preferably selected to be in the range of 0.5 to 5 cm, preferably in the range of 1 to 4.5 cm.

The quantity of the absorber material and the further components of the layer consisting of a material which absorbs harmful substances with which the porous supporting framework is coated is preferably selected to be in the range of 0 to 10 g/cm$^3$, preferably 0.01 to 1.0 g/cm$^3$, calculated as dry substance and related to the weight of the layer consisting of a material which absorbs harmful substances, including the porous supporting framework.

The casting mould according to the invention is characterised by an absorber layer in which harmful substances produced during casting and escaping from the casting mould together with other gaseous and solid components are absorbed or adsorbed. A further subject matter of the invention is a coating composition which absorbs harmful substances with which such an absorber layer can be produced.

A coating composition which absorbs harmful substances according to the invention for the coating of casting moulds for the casting of metals contains, according to the invention, at least one material which absorbs harmful substances.

The components of such a coating composition which absorbs harmful substances, in particular the physical adsorber materials and the chemical absorber materials have already been partly explained in detail in the description of the casting mould according to the invention. Reference is made to the corresponding passages.

The coating composition according to the invention is per se similar in its composition to a facing material such as is already used in the production of casting moulds, wherein however at least one material which absorbs harmful substances is additionally present.

The coating composition preferably comprises a carrier liquid in which the further components of the coating composition can be suspended or dissolved. This carrier liquid is suitably selected so that it can be completely vaporised under the usual conditions in metal casting. The carrier liquid should therefore preferably have a boiling point at normal pressure of less than about 130° C., preferably less than 110° C. Water is preferably used as carrier liquid. However, alcohols can also be used as carrier liquid such as, for example, ethanol or isopropanol, or mixtures of these carrier liquids.

The coating composition is preferably prepared in the form of a suspension or a paste. The solid content of the coating composition is therefore preferably selected in the range of 20 to 60 wt. %, preferably in the range of 30 to 50 wt. %. The coating composition can then be applied by usual methods such as spreading or spraying onto the surface of the casting mould.

If, according to a preferred embodiment, the above-described physical adsorber materials are present in the coating composition, their fraction is preferably selected in the range of 2.5 to 25 wt. %, preferably 4 to 15 wt. %, relative to the ready-to-use coating composition.

If, according to a preferred embodiment, the above-described chemical absorber materials are present in the coating composition, their fraction is preferably selected in the range of 3 to 15 wt. %, preferably 5 to 10 wt. %, relative to the ready-to-use coating composition.

If, according to a preferred embodiment, the above-described refractory materials are present in the coating composition, their fraction is preferably selected in the range of 10 to 30 wt. %, preferably 10 to 20 wt. %, relative to the ready-to-use coating composition.

In order to prevent any sinking of the solid components of the coating composition and at the same time achieve a uniform application to the casting mould, the viscosity of the coating composition is preferably selected in the range of 1000 to 3000 mPas, particularly preferably 1200 to 2000 mPas.

Preferably at least one powdery refractory material is suspended in the carrier liquid. The refractory materials already mentioned can be used as refractory material. Examples of suitable refractory materials are quartz, aluminium oxide, aluminium silicates such as pyropyllite, kyanite, andalusite or chamotte, zirconium sand, olivine, talc, mica, graphite, coke, feldspar. The refractory material is prepared in powder form. The grain size is selected so that a stable structure is formed in the absorber layer and that the coating compound can easily be distributed onto the gas outlet surfaces, preferably the upper side of the casting mould, by means of a spray device. The refractory material suitably has an average grain size in the range of 50 to 600 μm, particularly preferably in the range of 100 to 500 μm. Materials having a melting point higher than 1200° C. are particularly suitable as refractory material.

According to a preferred embodiment, the coating composition according to the invention comprises at least one binder as a further component. The binder allows better fixing of the coating on the surface, in particular in the surface of the casting mould. In addition, the binder increases the mechanical stability of the coating so that lower erosion is observed under mechanical loading or under the action of the gas flowing through the layer. Usual binders such as, for example, clays, in particular bentonite, can be used as binders. Other examples of binders are starch, dextrin, peptides, polyvinyl alcohol, polyacrylic acid, polystyrene and/or polyvinylacetate-polyacylate dispersions. Generally preferred are binder systems which can be used in aqueous systems and which after curing, do not re-soften under the action of air moisture.

According to a further embodiment, the coating composition according to the invention contains kieselsol as binder. The fraction of the binder in this case is preferably selected to be in the range of 0.1 to 20 wt. %, particularly preferably 0.5 to 5 wt. % relative to the weight of the coating composition. The kieselsol is preferably produced by neutralising water glass. The amorphous silicic acid obtained in this case preferably has a specific surface area in the range of 10 to 1000 m$^2$/g, particularly preferably in the range of 30 to 300 m$^2$/g.

The coating composition according to the invention can further comprise at least one correcting agent. The correcting agent effects an increase in the viscosity of the coating composition so that the solid components of the coating composition do not sink in the suspension or only sink to a small extent. Both organic and inorganic materials or mixtures of these materials can be used to increase the viscosity. Suitable inorganic correcting agents are, for example, strong swellable starches. Both two-layer silicates and three-layer silicates can be used as highly swellable sheet silicate such as, for example, attapulgite, serpentine, kaolins, smectites such as saponite, montmorillonite, beidellite and nontronite, vermiculite, illite, hectorite and mica. Hectorite also gives the coating composition thixotropic properties which facilitates the formation of the absorber layer on the casting mould since the coating composition no longer flows after application.

Possible organic correcting means are, for example, swellable polymers such as carboxymethyl, methyl, ethyl, hydroxyethyl and hydroxypropyl cellulose, mucilages, polyvinyl alcohols, polyvinyl pyrrolidone, pectin, gelatins, agar agar, polypeptides and alginates.

The coating composition according to the invention can contain further components which are usual in layers, for example, preservatives, defoamers, cross-linking agents and dispersing agents.

Cellulose ether, alginates, mucilages and/or pectins, for example, can be used as suspension agents. Examples of suitable cross-linking agents and dispersing agents are ionic and non-ionic, preferably non-ionic tensides.

The fraction of these further components in the ready-to-use coating composition is preferably selected to be less than 1 wt. %.

According to a preferred embodiment, the coating composition is prepared in a form in which it is applied to a porous supporting framework. Suitable support materials have already been described further above. The coating composition applied to the porous supporting framework can be prepared by preparing suitable mats already containing the coating composition. These can then be cut to shape according to the dimensions of the gas outlet surfaces of the casting mould to be covered, for example, the upper side of casting mould and placed on these. In this embodiment, the coating composition is preferably prepared in the still-moist state. The water content of the coating composition is preferably selected in the range of 5 to 30 wt. %, preferably in the range of 10 to 20 wt. %, relative to the coating composition.

A further subject matter of the invention relates to a process for producing a casting mould as has been described above.

In the process according to the invention

- a moulding material mixture comprising at least one refractory moulding material and at least one binder is prepared;
- the moulding material mixture is moulded into a casting mould and
- gas outlet surfaces of the casting mould are covered at least in sections with a layer consisting of a material which absorbs harmful substances.

Firstly, a casting mould is prepared in a manner known per se from a moulding material mixture. To produce the moulding material mixture, a refractory moulding material is mixed with a binder and then formed into a casting mould or a partial piece of a casting mould.

Per se, all refractory materials usual for the production of moulding for the foundry industry can be used as refractory material. Examples of suitable refractory moulding materials are quartz sand, zirconium sand, olivine sand, aluminium silicate sand and chrome ore sand or mixtures thereof. Quartz sand is preferably used. The refractory moulding material should have a sufficient particle size so that mouldings produced from the moulding material mixture have a sufficiently high porosity to allow escape of volatile compounds during the casting process. Preferably at least 70 wt. %, particularly preferably at least 80 wt. % of the refractory moulding material has a particle size of ≦290 μm. The average particle size of the refractory material should preferably be between 100 and 350 μm. The particle size can be determined, for example, by screen analysis. The refractory moulding material should be present in pourable form so that a binder or a liquid catalyst can be applied efficiently to the grains of the refractory moulding material, for example, in a mixer.

According to one embodiment, regenerated used sand can be used as refractory moulding material. Larger aggregates are removed from the used sand and the used sand is optionally separated into grains. Following a mechanical or thermal treatment, dust is removed from the used sand and this can then be reused. Before reuse the acid balance of the regenerated used sand is preferably checked. In particular, during a thermal regeneration, by-products such as carbonates contained in the sand can be converted into the corresponding oxide which then react in an alkaline manner. If binders which are cured under catalysis by an acid are used, the acid added as catalyst in this case can be neutralised by the alkaline components of the regenerated used sand. Likewise, during a mechanical regeneration of used sand, acid can remain in the used sand, which must be taken into account when producing the binder since otherwise the processing time of the moulding material mixture can be shortened.

The refractory moulding material should be dry. The refractory moulding material should preferably contain less than 1 wt. % water. In order to prevent premature curing of the binder by the action of heat, the refractory moulding material should not be too warm. The refractory moulding material should preferably have a temperature in the range of 20 to 35° C. Optionally, the refractory moulding material can be cooled or heated.

Per se, all binders such as are usual for producing casting moulds for the casting of metals can be used as binder. Both inorganic and organic binders can be used. Water glass, for example, can be used as an inorganic binder which is cured thermally or by introducing carbon dioxide. Examples of organic binders are polyurethane no-bake and cold-box binders, binders based on furan resins or phenol resins or epoxy acrylate binders.

Binders based on polyurethanes are generally made up of two components, wherein a first component contains a phenol resin and a second component contains a polyisocyanate. These two components are mixed with the refractory moulding material and the moulding material mixture is brought into a mould by ramming, blowing, shooting or another process, compacted and then cured. Depending on the method by which the catalyst is introduced into the moulding material mixture, a distinction is made between the "polyurethane no-bake process" and the "polyurethane cold-box process".

In the no-bake process a liquid catalyst, generally a liquid tertiary amine is introduced into the moulding material mixture before this is brought into a mould and cured. For producing the moulding material mixture, phenol resin, polyisocyanate and curing catalyst are mixed with the refractory moulding material. It is then possible to proceed, for example, by initially coating the refractory moulding material with one component of the binder and then adding the other component. The curing catalyst is added to one of the components. The ready-prepared moulding material. mixture must have a sufficiently long processing time so that the moulding material mixture is plastically deformed for a sufficiently long time and can be processed into a moulding. To this end, the polymerisation must take place correspondingly slowly so that a curing of the moulding material mixture does not already take place in the supply containers or supply lines. On the other hand, the curing must not take place too slowly in order to achieve a sufficiently high throughput during the production of casting moulds. The processing time can be influenced, for example, by adding retardants which slow the curing of the moulding material mixture. A suitable retardant is, for example, phosphorus oxychloride.

In the cold box method the moulding material mixture is firstly brought into a mould without a catalyst. A gaseous tertiary amine is then passed through the moulding material mixture which can optionally be mixed with an inert carrier gas. On contact with the gaseous catalyst, the binder binds very rapidly so that a high throughput is achieved in the production of casting moulds.

The binder systems based on polyurethanes contain a polyol component and a polyisocyanate component, wherein components known per se can be used here.

The polyisocyanate component of the binder system can comprise an aliphatic, cycloaliphatic or aromatic isocyanate. The polyisocyanate preferably contains at least two isocyanate groups, preferably two to five isocyanate groups per molecule. Depending on the desired properties, mixtures of isocyanates can also be used. The isocyanates used can consist of mixtures of monomers, oligomers and polymers and are therefore designated hereinafter as polyisocyanates.

Per se, any polyisocyanate which is usual in polyurethane binders for moulding material mixtures for the foundry industry can be used as polyisocyanates. Suitable polyisocyanates comprise aliphatic polyisocyanates, e.g. hexamethylene diisocyanate, alicyclic polyisocyanates such as, for example, 4,4'-dicyclohexylmethane diisocyanate and dimethyl derivatives thereof. Examples of suitable aromatic polyisocyanates are toluene-2,4-diisocyanate, toluene-2,6-diisocyanate, 1,5-naphthalene diisocyanate, xylylene diisocyanate and methyl derivatives thereof, diphenylmethane-4,4'-diisocyanate and polymethylene-polyphenyl polyisocyanate.

Although in principle, all conventional polyisocyanates react with the phenol resin to form a cross-linked polymer structure, preferably aromatic polyisocyanates are used, particularly preferably polymethylene-polyphenyl polyisocyanate such as, for example, commercially available mixtures of diphenylmethane-4,4'-diisocyanate, isomers and higher homologues thereof.

The polyisocyanates can be used both in substances and also dissolved in an inert or reactive solvent. A reactive solvent is in this case understood as a solvent which has a reactive group so that it is incorporated into the framework of the binder during setting of the binder. The polyisocyanates are preferably used in diluted form in order to be able to coat the grains of the refractory moulding material more efficiently with a thin film of the binder on account of the lower viscosity of the solution.

The polyisocyanates or their solutions in organic solvents are used in sufficient concentration to accomplish curing of the polyol component, usually in a range of 10 to 500 wt. % relative to the weight of the polyol component. Preferably 20 to 300 wt. % relative to the same base are used. Liquid polyisocyanates can be used in undiluted form, whilst solid or viscous polyisocyanates are dissolved in organic solvents. Up to 80 wt. %, preferably up to 60 wt. %, particularly preferably up to 40 wt. % of the isocyanate component can consist of solvents.

The polyisocyanate is preferably used in a quantity such that the number of isocyanate groups is 80 to 120% relative to the number of free hydroxyl groups of the polyol component.

Per se, all polyols used in polyurethane binders can be used as the polyol component. The polyol component contains at least two hydroxyl groups which can react with the isocyanate groups of the polyisocyanate component in order to achieve a cross-linking of the binder during curing and thereby a better strength of the cured moulding.

Preferably used as polyols are phenol resins obtained by condensation of phenols with aldehydes, preferably formaldehyde, in the liquid phase at temperatures up to about 180° C. in the presence of catalytic quantities of metal. The methods for producing such phenol resins are known per se.

The polyol component is preferably used in liquid form or dissolved in organic solvents in order to allow a homogeneous distribution of the binder on the refractory moulding material. The polyol component is preferably used in an anhydrous form because the reaction of the isocyanate component with water is an undesirable side reaction. Non-aqueous or anhydrous is intended to mean in this context a water content of the polyol component of preferably less than 5 wt. %, preferably less than 2 wt. %.

"Phenol resin" is understood as the reaction product of phenol, phenol derivatives, bisphenols and higher phenol condensation products with an aldehyde. The composition of the phenol resin is dependent on the specifically selected starting substances, the ratio of the starting substances and the reaction conditions. Thus, for example, the type of catalyst, the time and the reaction temperature play an important role in the same way as the presence of solvents and other substances.

The phenol resin is typically present as a mixture of different compounds and can contain in different ratios addition products, condensation products and non-converted starting compounds such as phenols, bisphenol and/or aldehyde.

"Addition product" is understood as reaction products in which an organic component substitutes at least one hydrogen at a previously non-substituted phenol or a condensation product. "Condensation product" is understood as reaction products having two or more phenol rings.

Condensation reactions of phenols with aldehydes result in phenol resins which, depending on the quantitative ratios of the educts, the reaction conditions and the catalysts used are divided into two product classes, the novolacs and resols:

Novolacs are soluble, fusible, non-self-curing and storage-stable oligomers having a molecular weight in the range of about 500 to 5000 g/mol. They accumulate during the condensation of aldehydes and phenols in the molar ratio of 1:>1 in the presence of acidic catalysts. Novolacs are phenol resins free from methylol groups in which the phenyl nuclei are linked via methylene bridges. They can be cured following the addition of curing agents such as formaldehyde-donating agents, preferably hexamethylene tetramine, at elevated temperature by cross-linking.

Resols are mixtures of hydroxymethyl phenols which are linked via methylene and methylene ether bridges and can be obtained by reaction of aldehydes and phenols in the molar ratio of 1:<1, possibly in the presence of a catalyst, e.g. a basic catalyst. They have a molar weight $M_w$ of ≦10,000 g/mol.

Phenol resins which are particularly suitable as polyol components are known under the designation "o-o'" or "high-ortho" novolacs or benzylether resins. These can be obtained by condensation of phenols with aldehydes in weakly acidic medium using suitable catalysts.

Suitable catalysts for producing benzylether resins are salts of divalent ions of metals such as Mn, Zn, Cd, Mg, Co, Ni, Fe, Pb, Ca and Ba. Zinc acetate is preferably used. The quantity used is not critical. Typical quantities of metal catalyst are 0.02 to 0.3 wt. %, preferably 0.02 to 0.15 wt. %, relative to the total quantity of phenol and aldehyde.

All conventionally used phenols are suitable for producing phenol resins. In addition to unsubstituted phenols, substituted phenols or mixtures thereof can also be used. The phenol compounds are either not substituted in both ortho positions or in one ortho and in the para position to allow polymerisation. The remaining ring carbon atoms can be substituted. The choice of the substituent is not particularly restricted provided that the substituent does not disadvantageously influence the polymerisation of the phenol or the aldehyde. Examples of substituted phenols are alkyl-substituted phenols, alkoxy-substituted phenols and aryloxy-substituted phenols.

The aforesaid substituents have, for example, 1 to 26, preferably 1 to 15 carbon atoms. Examples of suitable phenols are o-cresol, m-cresol, p-cresol, 3,5-xylol, 3,4-xylol, 3,4,5-trimethylphenol, 3-ethylphenol, 3,5-diethylphenol, p-butylphenol, 3,5-dibutylphenol, p-amylphenol, cyclohexylphenol, p-octylphenol, p-nonylphenol, 3,5-dicyclohexylphenol, p-crotylphenol, p-phenylphenol, 3,5-dimethoxyphenol and p-phenoxyphenol.

Phenol itself is particularly preferred. Higher condensed phenols such as bisphenol A are also suitable. Polyvalent phenols having more than one phenolic hydroxyl group are also suitable. Preferred polyvalent phenols have two or four phenolic hydroxyl groups. Special examples of suitable polyvalent phenols are pyrocatechol, resorcin, hydroquinone, pyrogallol, fluoroglycin, 2,5-dimethylresorcin, 4,5-dimethylresorcin, 5-methylresorcin or 5-ethylresorcin.

Mixtures of different mono- and polyvalent and/or substituted and/or condensed phenol components can also be used to produce the polyol component.

In one embodiment, phenols having the general formula I:

Formula I

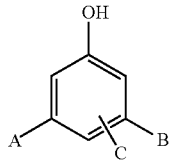

are used to produce the phenol resin component, wherein A, B and C are selected independently of one another from a hydrogen atom, a branched or unbranched alkyl group which, for example, can have 1 to 26, preferably 1 to 15 carbon atoms, a branched or unbranched alkoxy group which, for example, can have 1 to 26, preferably 1 to 15 carbon atoms, a branched or unbranched alkenoxy group which, for example, can have 1 to 26, preferably 1 to 15 carbon atoms, an aryl or alkylaryl group such as, for example, bisphenyls.

Aldehydes having the formula:

R—CHO, are suitable for producing the phenol resin component, where R is a hydrogen atom or a carbon atomic group having preferably 1 to 8, particularly preferably 1 to 3 carbon atoms. Special examples are formaldehyde, acetaldehyde, propionaldehyde, furfurylaldehyde and benzaldehyde. Formaldehyde is particularly preferably used, either in its aqueous form, as paraformaldehyde or trioxane.

In order to obtain phenol resins, an at least equivalent molar number of aldehyde relative to the molar number of the phenol component should be used. The molar ratio of aldehyde to phenol is preferably 1:1.0 to 2.5:1, particularly preferably 1.1:1 to 2.2:1, especially preferably 1.2:1 to 2.0:1.

The phenol resin component is produced by processes known to the person skilled in the art. In this case, the phenol and the aldehyde are reacted under substantially anhydrous conditions in the presence of a bivalent metal ion at temperatures of preferably less than 130° C. The water produced is distilled off. For this purpose a suitable entrainer, for example, toluene or xylene, can be added to the reaction mixture or the distillation is carried out at reduced pressure.

For the binder of the moulding material mixture, the phenol component is reacted with an aldehyde, preferably to give benzylether resins. The reaction with a primary or secondary aliphatic alcohol to give an alkoxy-modified phenol resin in a single-stage or two-stage process (EP-B-0 177 871 and EP 1 137 500) is also possible. In the single-stage process the phenol, the aldehyde and the alcohol are reacted in the presence of a suitable catalyst. In the two-stage process a non-modified resin is initially produced and this is then reacted with an alcohol. When using alkoxy-modified phenol resins, there is per se no restriction regarding the molar ratio but the alcohol component is preferably used in an alcohol: phenol molar ratio of less than 0.25, so that less than 25% of the hydroxymethyl groups are etherised. Suitable alcohols are primary and secondary aliphatic alcohols having a hydroxy group and 1 to 10 carbon atoms. Suitable primary and secondary alcohols are, for example, methanol, ethanol, propanol, n-butanol and n-hexanol. Methanol and n-butanol are particularly preferred.

The phenol resin is preferably selected so that cross-linking with the polyisocyanate component is possible. Phenol resins comprising molecules having at least two hydroxy groups in the molecule are particularly suited for the structure of a network. The phenol resin component or the isocyanate component of the binder system is preferably used as a solution in an organic solvent or a combination of organic solvents. Solvents can be necessary to keep the components of the binder in a sufficiently low-viscosity state. This is necessary inter alia to obtain a uniform cross-linking of the refractory moulding material and its pourability.

Per se, all solvents conventionally used in such binder systems for foundry technology can be used as solvent for the polyisocyanate or polyol component of the polyurethane-based binder system. Oxygen-rich, polar organic solvents, for example, are suitable as solvents. Particularly suitable are dicarboxylic acid esters, glycol ether esters, glycol diesters, glycol diethers, cyclic ketones, cyclic esters or cyclic carbonates. Dicarboxylic acid esters, cyclic ketones and cyclic carbonates are preferably used. Dicarboxylic acid esters have the formula $R^aOOC—R^b—COOR^a$ wherein the groups $R^a$ in each case independently of one another constitute an alkyl group having 1 to 12, preferably 1 to 6 carbon atoms and $R^b$ is an alkylene group, i.e. a divalent alkyl group having 1 to 12, preferably 1 to 6 carbon atoms. $R^b$ can also comprise one or more carbon-carbon double bonds. Examples are dimethyl esters of carboxylic acids having 4 to 10 carbon atoms, which are available, for example, under the designation "dibasic ester" (DBE) from Invista International S.à.r.l., Geneva, CH. Glycol ether esters are compounds having the formula $R^c—O—R^d—OOCR^e$, wherein $R^c$ is an alkyl group having 1 to 4 carbon atoms, $R^d$ is an ethylene group, a propylene group or an oligomeric ethylene oxide or propylene oxide and $R^e$ is an alkyl group with 1 to 3 carbon atoms. Glycol ether acetates, e.g. butyl glycol acetate are preferred. Glycol diesters accordingly have the general formula $R^eCOO—R^dOOCR^e$, wherein $R^d$ and $R^e$ are defined as before and the groups $R^e$ are each selected independently of one another. Glycol diacetates such as, for example, propylene glycol diacetate are preferred. Glycol diethers can be characterised by the formula $R^c—O—R^d—O—R^c$, wherein $R^c$ and $R^d$ are defined as before and the groups $R^c$ are each selected independently of one another. A suitable glycol diether is, for example, dipropylene glycol dimethyl ether. Cyclic ketones, cyclic esters and cyclic carbonates having 4 to 5 carbon atoms are also suitable. A suitable cyclic carbonate, for example, is propylene carbonate. The alkyl and alkylene groups can each be branched or unbranched.

The fraction of the solvent in the binder system is preferably not selected to be too high since the solvent vaporises during the production and application of the moulding produced from the moulding material mixture and thus, for example, can lead to an odour nuisance or to the evolution of smoke during casting. The fraction of the solvent in the binder system is preferably less than 50 wt. %, particularly preferably less than 40 wt. %, particularly preferably less than 35 wt. %.

In order to produce the moulding, firstly as described above the binder is mixed with the refractory moulding material to form a moulding material mixture. If the moulding is to be produced by the PU no-bake method, a suitable catalyst can already be added to the moulding material mixture. For this purpose liquid amines are preferably added to the moulding material mixture. These amines preferably have a $pK_b$ value of 4 to 11. Examples of suitable catalysts are 4-alkyl pyridine, wherein the alkyl group comprises 1 to 4 carbon atoms, isochinoline, aryl pyridines such as phenyl pyridine, pyridine, acryline, 2-methoxypyridine, pyridazine, 3-chloropyridine, chinoline, n-methylimidazole, 4,4'-dipyridine, phenyl propyl pyridine, 1-methyl benzimidazole; 1,4-thiazine, N,N-dimethyl benzylamine, triethylamine, tribenzylamine, N,N-dimethyl-1,3-propane diamine, N,N-dimethyl ethanolamine and triethanolamine. The catalyst can optionally be diluted with an inert solvent, for example, 2,2,4-trimethyl-1,3-pentadiol diisobutyrate or a fatty acid ester. The quantity of added catalyst is selected in the range of 0.1 to 15 wt. % relative to the weight of the polyol component.

The moulding material mixture is then introduced into a mould by usual means and compacted there. The moulding material mixture is then cured to give a moulding. During the curing the moulding should preferably retain its external shape.

If the curing should take place by the PU cold-box method, a gaseous catalyst is passed through the moulded moulding material mixture. The usual catalyst in the field of the cold-box process can be used as catalyst. It is particularly preferable to use amines as catalysts, especially preferably dimethylethylamine, dimethyl-n-propylamine, dimethyl isopropylamine, dimethyl-n-butylamine, triethylamine and trimethylamine in their gaseous form or as an aerosol.

According to a further preferred embodiment, a furan resin or a phenol resin is used as binder, wherein the moulding material mixture is cured according to the furan no-bake method under catalysis by a strong acid.

Furan and phenol resins exhibit very good decomposition properties during casting. Under the action of the heat of the liquid metal, the furan or phenol resin decomposes and the strength of the casting mould is lost. After casting, cores can therefore be poured out from cavities very efficiently, possibly after preliminary shaking of the casting.

The reactive furan resins contained as the first component in "furan no-bake binders" comprise furfuryl alcohol as the essential component. Furfuryl alcohol can react with itself under acid catalysis and form a polymer. Generally, pure furfuryl alcohol is not used to produce furan no-bake binders but further compounds are added to the furfuryl alcohol which can be polymerised into the resin. Examples of such compounds are aldehydes such as formalehyde or furfural, ketones such as acetone, phenols, urea or polyols such as sugar alcohols or ethylene glycol. Further components which influence the properties of the resin, for example, its elasticity, can be added to the resins. Melamine can be added, for example, to bind free formaldehyde.

Furan no-bake binders are usually constituted by firstly producing furfuryl-containing pre-condensates for example, from urea, formaldehyde and furfuryl alcohol under acid conditions. The reaction conditions are selected so that only slight polymerisation of the furfuryl alcohol occurs. These pre-condensates are then diluted with furfuryl alcohol. Resols can also be used to produce furan no-bake binders. Resols are produced by polymerisation of mixtures of phenol and formaldehyde. These resols are then diluted with furfuryl alcohol.

The second component of the furan no-bake binder is formed by an acid. This acid on the one hand neutralises alkaline components contained in the refractory moulding material and on the other hand, catalyses the cross-linking of the reactive furan resin.

Usually, aromatic sulphonic acids and in some special cases phosphoric acid or sulphuric acid are used as acids. Phosphoric acid is used in concentrated form, i.e. at concentrations of more than 75%. However, this is only suitable for the catalytic curing of furan resins having a relatively high fraction of urea. The nitrogen content of these resins is more than 2.0 wt. %. Sulphuric acid can be added to weaker acids as a relatively strong acid as a starter for the curing of the furan resins. During casting however, a typical odour for sulphur compounds develops. In addition, there is the risk that sulphur will be absorbed by the casting material and influence its properties. Usually aromatic sulphonic acids are used as catalysts. On account of their good availability and their high acidic strength, toluene sulphonic acid, xylene sulphonic acid and benzene sulphonic acid are primarily used.

Phenol resins as the second group of acid-catalysed curable no-bake binders contain resols as the reactive resin component, i.e. phenol resins which were produced with an excess of formaldehyde. Compared to furan resins, phenol resins show a significantly lower reactivity and require strong sulphonic acids as catalysts. Phenol resins have a relatively high viscosity which increases during prolonged storage of the resin. In particular at temperatures below 20° C., the viscosity increases strongly so that the sand must be heated to enable the binder to be applied uniformly to the surface of the sand grains. After the phenol no-bake binder has been applied to the refractory moulding material, the moulding material mixture should be processed as immediately as possible in order to avoid any deterioration in the quality of the moulding material mixture due to premature curing, which can lead to a deterioration in the strength of the casting moulded produced from the moulding material mixture. When using phenol no-bake binders, the flowability of the moulding material mixture is usually poor. When producing the casting mould, the moulding material mixture must therefore be carefully compacted in order to achieve a high strength of the casting mould.

The production and processing of the moulding material mixture should take place at temperatures in the range of 15 to 35° C. If the temperature is too low, the moulding material mixture is difficult to process on account of the high viscosity of the phenol no-bake resin. At temperatures higher than 35° C., the processing time is shortened due to premature curing of the binder.

After casting, the moulding material mixtures based on phenol no-bake binders can be processed again, in which case mechanical or thermal or combined mechanical/thermal methods can be used here.

An acid is then applied to the pourable refractory material, an acid-coated refractory moulding material being obtained. The acid is applied by usual methods to the refractory moulding material, for example, by spraying the acid onto the refractory moulding material. The quantity of acid is preferably selected to be in the range of 5 to 45 wt. %, particularly preferably in the range of 20 to 30 wt. %, relative to the weight of the binder and calculated as pure acid, i.e. neglecting any solvent used. If the acid is not already present in liquid form and has a sufficiently low viscosity to be distributed onto the grains of the refractory moulding material in the form of a thin film, the acid is dissolved in a suitable solvent. Examples of solvents are water or alcohol or mixtures of water and alcohol. In particular, when using water, the solution is however made to be as concentrated as possible in order to keep the amount of water entrained into the binder or the moulding material mixture as low as possible. The mixture of refractory moulding material and acid is thoroughly homogenised to ensure uniform distribution of the acid on the grains An acid-curable binder is then applied to the acid-coated refractory moulding material. The quantity of binder is preferably, selected in the range of 0.25 to 5 wt. %, particularly preferably in the range of 1 to 3 wt. %, relative to the refractory moulding material and calculated as resin component. Per se, all binders which are curable by acid, in particular those acid-curable binders that are already common for producing moulding material mixtures for the foundry industry, can be used as acid-curable binders. In addition to a cross-linkable resin, the binder can also contain other usual components, for example, solvents for adjusting the viscosity or extenders which replace some of the cross-linkable resin.

The binder is applied to the acid-coated refractory moulding material and is distributed onto the grains of the refractory moulding material in the form of a thin film by moving the mixture.

The quantities of binder and acid are selected so that on the one hand a sufficient strength of the casting mould and on the other hand a sufficient processing time of the moulding material mixture is achieved. A processing time in the range of 5 to 45 minutes, for example, is suitable.

The refractory moulding material coated with the binder is then moulded into a moulding by usual methods. To this end, the moulding material mixture can be introduced into a suitable mould and compacted there. The moulding thus obtained is then allowed to cure.

Per se, all furan resins which are already used in furan no-bake binder systems can be used as furan no-bake binders.

The furan resins used in commercial furan no-bake binders are usually pre-condensates or mixtures of furfuryl alcohol with other monomers or pre-condensates. The pre-condensates contained in the furan no-bake binders are produced in a manner known per se.

According to a preferred embodiment, furfuryl alcohol is used in combination with urea and/or formaldehyde or urea/formaldehyde pre-condensates. Formaldehyde can be used in monomeric form, for example, in the form of a formalin solution, and also in the form of its polymers such as trioxane or paraformaldehyde. In addition to or instead of formaldehyde, other aldehydes or also ketones can also be used. Suitable aldehydes are, for example, acetaldehyde, propionaldehyde, butyraldehyde, acrolein, crotonaldehyde, benzaldehyde, salicylaldehyde, cinnamaldehyde, glyoxal and mixtures of these aldehydes. Formaldehyde is preferred, this being preferably used in the form of paraformaldehyde.

All ketones having a sufficiently high reactivity can be used as the ketone component. Examples of ketones are methyl ethyl ketone, methyl propyl ketone and acetone, acetone being preferably used.

The said aldehydes and ketones can be used as a single compound and also in a mixture with one another.

The molar ratio of aldehyde, in particular formaldehyde, or ketone to furfuryl alcohol can be selected within further ranges. Preferably 0.4 to 4 mol of furfuryl alcohol, preferably 0.5 to 2 mol of furfuryl alcohol per mol of aldehyde can be used in the production of furan resins.

In order to produce the pre-condensates, furfuryl alcohol, formaldehyde and urea can be heated to boiling, after adjusting to a pH higher than 4.5, water being continuously distilled off from the reaction mixture. The reaction time can be several hours, for example, 2 hours. Under these reaction conditions, almost no polymerisation of the furfuryl alcohol occurs. However, the furfuryl alcohol is condensed together with the formaldehyde and the urea into a resin.

According to an alternative method, furfuryl alcohol, formaldehyde and urea are reacted in the heat at a pH significantly below 4.5, for example, at a pH of 2.0, wherein the water formed during condensation can be distilled off at reduced pressure. The reaction product has a relatively high viscosity and is diluted with furfuryl alcohol until the desired viscosity is adjusted to produce the binder.

Mixed forms of these production processes can also be used.

It is also possible to introduce phenol into the pre-condensate. For this purpose the phenol can be initially reacted with formaldehyde under alkaline conditions to form a resol resin. This resol can then be reacted or mixed with furfuryl alcohol or a furan-group containing resin. Such furan-group containing resins can be obtained, for example, by the processes described above. Higher phenols, for example, resorcin, cresols or bisphenol A can also be used to produce the pre-condensate. The fraction of the phenol or the higher phenol in the binder is preferably selected in the range of up to 45 wt. %, preferably up to 20 wt. %, particularly preferably up to 10 wt. %. According to one embodiment, the fraction of the phenol or higher phenols can be selected to be greater than 2 wt. %, according to a further embodiment, greater than 4 wt. %:

It is furthermore also possible to use condensates of aldehydes and ketones which are then mixed with furfuryl alcohol to produce the binder. Such condensates can be produced by reaction of aldehydes and ketones under alkaline conditions. Preferably formaldehyde, in particular in the form of paraformaldehyde is used as aldehyde. Preferably acetone is used as the ketone. However, other aldehydes or ketones can also be used. The relative molar ratio of aldehyde to ketone is preferably selected in the range of 7:1 to 1:1, preferably 1.2:1 to 3.0:1. The condensation is preferably carried out under alkaline conditions at pH values in the range of 8 to 11.5, preferably 9 to 11. A suitable base, for example, is sodium carbonate.

The quantity of furfuryl alcohol contained in the furan no-bake binder is determined on the one hand by the desire to keep the fraction as low as possible for cost reasons. On the other hand, an improvement in the strength of the casting mould is achieved by a high fraction of furfuryl alcohol. If the fraction of furfuryl alcohol in the binder is very high however, very brittle casting moulds are obtained which are difficult to process. The fraction of furfuryl alcohol in the binder is preferably selected to be in the range of 30 to 95 wt. %, preferably 50 to 90 wt. %, particularly preferably 60 to 85 wt. %. The fraction of urea and/or formaldehyde in the binder is preferably selected to be in the range of 2 to 70 wt. %, preferably 5 to 45 wt. %, particularly preferably 15 to 30 wt. %. The fractions comprise both the non-bound fractions of these compounds contained in the binder and also the fractions bound in the resin.

Further additives can be added to the furan resins, such as ethylene glycol or similar aliphatic polyols, for example, sugar alcohols such as sorbitol which serve as extenders and replace some of the furfuryl alcohol. In an unfavourable case, a too-high addition of such extenders can lead to a reduction in the strength of the casting mould and lowering of the reactivity. The fraction of these extenders in the binder will therefore preferably be selected to be less than 25 wt. %, preferably less than 15 wt. % and particularly preferably less than 10 wt. %. In order to achieve a cost saving without having to accept an excessive influence on the strength of the casting mould, according to one embodiment the fraction of the extenders is selected to be greater than 5 wt. %.

The furan no-bake binders can also contain water. However, since water slows the curing of the moulding material mixture and water is formed as a reaction product during the curing, the fraction of water is preferably kept as low as possible. The fraction of water in the binder is preferably less than 20 wt. %, preferably less than 15 wt. %. From economic aspects, an amount of water greater than 5 wt. % can be tolerated in the binder.

In the process according to the invention, resols are used as phenol resins. Resols are mixtures of hydroxymethyl phenols which are linked via methylene and methylene ether bridges and can be obtained by reaction of aldehydes and phenols in the molar ratio of 1:<1, possibly in the presence of a catalyst, e.g. a basic catalyst. They have a molar weight $M_w$ of ≦10,000 g/mol.

All conventionally used phenols are suitable for producing the phenol resins, phenol being particularly preferred. Formaldehyde is preferably used as the aldehyde component, in particular in the form of paraformaldehyde. Alternative phenols and aldehydes have already been explained in connection with the polyurethane binders. Reference is made to the relevant passages.

The binders can contain further usual additives, for example, silanes as adhesion promoters. Suitable silanes are, for example, aminosilanes, epoxysilanes, mercaptosilanes, hydroxysilanes and ureidosilanes such as γ-hydroxypropyl trimethoxysilane, γ-aminopropyl trimethoxysilane, 3-ureidopropyl triethoxysilane, γ-mercaptopropyl trimethoxysilane, γ-glycidoxypropyl trimethoxysilane, β-(3,4)-epoxycyclohexyl) trimethoxysilane, N-β-(aminoethyl)-γ-aminopropyl trimethoxysilane.

If such a silane is used, it will be added to the binder in a fraction of 0.1 to 3 wt. %, preferably 0.1 to 1 wt. %.

The binders can also contain other usual components such as, for example, activators or softeners.

In addition to the refractory moulding material, the binder and possibly the catalyst, the moulding material mixture can also contain other usual components. Examples of other components are iron oxide, ground flax fibers, wood flour granules, ground charcoals or clay.

The moulding material mixture is then moulded by usual methods to form a casting mould or a part of a casting mould and optionally cured. After the casting mould has possibly been assembled and the moulding cavity provided in the casting mould has been coated with a facing material, a layer consisting of a material which absorbs harmful substances is applied, at least in sections, to the gas outlet surfaces, particularly preferably the upper side of the casting mould. In this case, all the usual methods for applying such coating compositions can be used per se. The coating can be applied to the upper side of the casting mould with a brush or sprayed on by means of a suitable device. Likewise, the coating can be poured onto the upper side of the casting mould and excess coating composition possibly allowed to run off.

The coating composition can then optionally be dried. However, the layer preferably still has a water content in the range of 0 to 60 wt. %, preferably 5 to 30 wt. %, particularly preferably 10 to 20 wt. %.

According to a preferred embodiment, a layer of a porous supporting framework is initially applied to the upper side of the casting mould. As has already been explained, such a porous supporting framework can be formed, for example, from a solid foam, a fabric or a fleece. Suitable materials have already been described further above. The thickness of the porous supporting framework is preferably selected in the range of 0.5 to 5 cm. A coating composition is then applied to the porous supporting framework placed on the upper side of the casting mould, as has been described above so that the porous supporting framework is impregnated with the coating composition. The layer can then optionally be dried.

Alternatively, the porous supporting material can firstly be coated with the coating composition and the coated porous supporting material can then be applied, at least in sections, to gas outlet surfaces of the casting mould.

A further subject matter of the invention relates to the use of the casting mould described above which according to the invention comprises an absorber layer, as described above, for the casting of metals, in particular the casting of iron and steel.

The invention will be explained in detail hereinafter with reference to examples.

Determination of the Bulk Weight

A measuring cylinder cut off at the 1000 ml mark is weighed. The sample to be studied is then poured into the measuring cylinder in a single operation by means of a powder funnel such that a bulk cone is formed above the termination of the measuring cylinder. The bulk cone is scraped away with the aid of a ruler passed over the opening of the measuring cylinder and the filled measuring cylinder is reweighed. The difference corresponds to the bulk weight.

EXAMPLE 1

100 parts by weight of H 32 quartz sand (Quartzwerke Frechen, DE) were mixed with 0.4 parts by weight of curing agent in a mixer. The mixture was agitated for one minute to uniformly distribute the curing agent. Then 1.0 parts by weight of furan resin was added and the mixture was agitated for another minute. A tubular casting mould, which is open at the top and has a base, was produced as a test specimen from the moulding material mixture obtained. The casting mould had an inside diameter of 5 cm, a wall thickness of 5 cm and a height of 30 cm. The composition of the moulding material mixture studied is summarised in Table 1.

TABLE 1

Composition of the moulding material mixture

| | Moulding material mixture |
|---|---|
| Quartz sand H 32 | 100 parts by weight |
| Methane sulphonic acid (70%)/ lactic acid (80%) = 50:50 | 0.4 parts by weight |
| Furfuryl alcohol urea resin[a] | 1.0 parts by weight |

[a]Askuran EP 3576, Ashland-Sudchemie-Kernfest GmbH, Hilden DE

Furthermore, a coating composition was prepared from the components specified in Table 2, by initially supplying the water and then adding the clay and solubilising using a high-shearing agitator for 15 minutes. The absorbing components, pigments and dyes were then stirred in for another 15 minutes until a homogeneous mixture was obtained.

TABLE 2

Composition of the coating composition

| Component | Fraction (wt. %) |
|---|---|
| Calcium carbonate | 15.00 |
| Aluminium silicate (coarse) | 30.00 |
| Activated charcoal | 5.00 |
| Clay mineral | 3.00 |
| Lime | 7.00 |

TABLE 2-continued

| Composition of the coating composition | |
|---|---|
| Component | Fraction (wt. %) |
| Defoamer | 0.20 |
| Biocide | 0.20 |
| Water | 39.60 |

The side surfaces of the test specimen were coated with the coating composition by means of a brush, a layer having a thickness of 2.5 mm being obtained. The upper side of the test specimen was sealed with a gas-impermeable facing material (Keratop® V107G, ASK Chemicals, Hilden DE). The test specimen was then dried for a maximum of 30 minutes at room temperature.

Then, 4.3 kg of liquid iron was poured into the test specimen (casting temperature 1400° C.). The ratio by weight of test specimen and iron was about 1:1.

The sulphur content of the coating composition before and after casting was determined by means of infrared spectroscopy.

The benzene content of the coating composition before and after casting was determined quantitatively and qualitatively by means of gas chromatography following DIN EN 14662-2. The values determined are summarised in Table 3.

TABLE 3

| Sulphur and benzene content of the coating composition | | |
|---|---|---|
| | Content | |
| Component | Before casting | After casting |
| Sulphur (wt. %) | 0.028 | 2.26 |
| Benzene (mg/kg) | 0.035 | 0.28 |

The coating composition exhibited a significantly increased content of sulphur and benzene after casting.

EXAMPLE 2

Comparable measurements were made in an iron foundry under practical conditions. For this purpose a casting having a weight of about 250 kg (casting temperature about 1400° C.) was produced. The weight ratio of moulding material mixture to iron was about 4:1. The composition, of the moulding material mixture used to produce the casting mould is summarised in Table 4.

TABLE 4

| Composition of the moulding material mixture | |
|---|---|
| | Moulding material mixture |
| Quartz sand H 31 | 100 parts by weight |
| Methane sulphonic acid (70%)/ lactic acid (80%) = 50:50 | 0.35 parts by weight |
| Furfuryl alcohol urea resin[a] | 0.80 parts by weight |

In each case, a casting having an uncoated casting mould (system 1) was produced and a casting having a casting mould whose upper side had been coated with a 2.5 mm thick layer of the coating composition produced as described above (system 2).

The waste gases produced during casting were captured via a waste gas hood. A defined partial stream was extracted from the waste gas stream by means of a removal probe and the substances contained in the partial stream were adsorbed on activated charcoal by reference to the method according to DIN EN 14662-2. The qualitative and quantitative analysis of the adsorbed substances (benzene, toluene and xylene) was made by means of gas chromatography.

In order to determine the sulphur dioxide content, a partial stream was removed from the waste gas and extracted into a PE bag using a vacuum device. The concentration of sulphur dioxide was determined by means of mass spectrometry.

The gas samples were further studied by trained probands for their odour intensity.

The values determined in the waste gases are summarised in Table 5.

TABLE 5

| Harmful substance contents in the waste gases released during casting | | |
|---|---|---|
| Sulphur (wt. %) | System 1 (not according to the invention) | System 2 (according to the invention) |
| Odour units (GE/m$^3$) | 34700 | 27000 |
| Benzene (mg/kg) | 24.2 | 6.2 |
| Toluene (mg/kg) | 22.0 | 10.3 |
| Xylene (mg/kg) | 0.6 | <0.5 |
| $SO_2$ (ppm vol) | 24.5 | 16.9 |

A significant reduction of the odour nuisance and harmful substances in the waste gas can be achieved by the coating composition.

The invention claimed is:

1. A casting mould for the casting of metals, comprising a layer of a material which absorbs harmful substances and is permeable to gas is arranged on at least sections of gas outlet surfaces on the outer surface of the casting mould.

2. The casting mould according to claim 1, wherein the layer of a material which absorbs harmful substances has a thickness of at least 2.5 mm.

3. The casting mould according to claim 1, wherein the layer of a material which absorbs harmful substances comprises at least one physical adsorber material which can physically adsorb harmful substances.

4. The casting mould according to claim 3, wherein the physical adsorber material has a specific surface area of at least 800 m$^2$/g.

5. The casting mould according to claim 3, wherein the physical adsorber material is selected from activated charcoal, silica gel, clays digested by an acid, ashes, cellulose, rayon staple.

6. The casting mould according to claim 1, wherein the layer of a material which absorbs harmful substances contains at least one chemical absorber material, which can bind or decompose harmful materials by a chemical reaction.

7. The casting mould according to claim 6, wherein the chemical absorber material is a basic material.

8. The casting mould according to claim 7, wherein the basic material is selected from oxides, hydroxides and carbonates of the alkali metals and alkaline-earth metals.

9. The casting mould according to claim 1, wherein the layer of a material which absorbs harmful substances contains at least one refractory material which has an average grain size of at least 100 μm.

10. The casting mould according to claim 1, wherein the layer of a material which absorbs harmful substances comprises a porous supporting framework.

11. A process for producing a casting mould comprising:

preparing a moulding material mixture comprising at least one refractory moulding material and at least one binder; and molding the moulding material mixture into the casting mould, wherein gas outlet surfaces on the outer surface of the casting mould are covered at least in sections with a layer of a material which absorbs harmful substances and is permeable to gas.

12. The process according to claim 11, wherein the layer of a material which absorbs harmful substances is provided by applying a porous supporting framework to at least sections of the gas outlet surfaces of the casting mould.

13. The process according to claim 11, wherein the at least one binder is an organic binder.

14. The casting mould according to claim 1, wherein the layer of a material which absorbs harmful substances has a thickness of at least 5 mm.

* * * * *